US006839673B1

(12) United States Patent
Choi et al.

(10) Patent No.: US 6,839,673 B1
(45) Date of Patent: Jan. 4, 2005

(54) DIGITAL WATERMARKING METHOD AND APPARATUS FOR AUDIO DATA

(75) Inventors: Jong Uk Choi, Seoul (KR); Jung Seok Cho, Seoul (KR); Jong Weon Kim, Daejeon (KR)

(73) Assignee: Markany Inc., Seoul (KR)

( * ) Notice: Subject to any disclaimer, the term of this patent is extended or adjusted under 35 U.S.C. 154(b) by 0 days.

(21) Appl. No.: 09/537,308

(22) Filed: Mar. 29, 2000

(30) Foreign Application Priority Data

Mar. 29, 1999 (KR) ..... 1999-10821
Mar. 27, 2000 (KR) ..... 2000-15406

(51) Int. Cl.[7] ..... G10L 21/00
(52) U.S. Cl. ..... 704/273
(58) Field of Search ..... 375/216; 704/273, 704/220, 270; 382/100

(56) References Cited

U.S. PATENT DOCUMENTS 5,687,191 A * 11/1997 Lee et al. ..... 375/216
5,727,092 A 3/1998 Sandford, II et al.
5,809,139 A 9/1998 Girod et al.
5,875,249 A 2/1999 Mintzer et al.
5,930,369 A * 7/1999 Cox et al. ..... 380/54
6,240,121 B1 * 5/2001 Senoh ..... 375/130
6,285,775 B1 * 9/2001 Wu et al. ..... 382/100

FOREIGN PATENT DOCUMENTS

WO WO 00/16516 3/2000

* cited by examiner

*Primary Examiner*—W. R. Young
*Assistant Examiner*—Jakieda Jackson
(74) *Attorney, Agent, or Firm*—Nath & Associates, PLLC; Harold L. Novick

(57) ABSTRACT

Digital watermarking of digital audio is performed by Fourier transforming digital audio data, wavelet transforming the magnitude components of the Fourier transform coefficients of the digital audio data, discrete cosine transforming a watermark signal, multiplying the sign of the wavelet transform coefficients of the magnitude components to the coefficients of the discrete cosine transformed watermark signal, adding the coefficients of the Fourier transformed digital audio data and the adjusted discrete cosine transformed watermark signal, and inverse wavelet transforming the audio signal's coefficients before inverse Fourier transformation to finally generate watermark-embedded audio signal data.

24 Claims, 2 Drawing Sheets

DIGITAL WATERMARKING METHOD AND APPARATUS FOR AUDIO DATA

BACKGROUND OF THE INVENTION

1. Technical Field

The present invention relates to digital watermarking of data, including audio, video, and multimedia data. Specifically, the invention relates to embedding a watermark signal into digital audio data.

2. Description of the Related Art

The proliferation of digitized media such as image, video and multimedia is creating a need for security system which facilitates the identification of the source of the material. Particularly, the internet is increasingly used for transmitting recorded music in a digitized format. Content providers, i.e., owners of such recorded music in digital form, have a need to embed into multimedia data a predetermined mark which can subsequently be detected by software and/or hardware devices for purposes of authenticating copyright ownership, control and management of the multimedia data. Digital watermarking has been developed as a technique for embedding an identifiable data into multimedia data.

Conventionally, a watermark signal used for watermarking audio signal has been relatively simple signals such as a sequence of code symbols because, unlike image or video, inserting a large watermark signal would affect original audio perceptibility. Therefore, a watermarking technique employing a large image as a watermark signal has been proposed. However, prior arts watermarking techniques involving an image watermark are susceptible to unauthorized removal of watermarks, thereby making hard to trace the origin of a copyright protected material.

SUMMARY OF THE INVENTION

An objective of the present invention is to provide a digital watermarking technique that does not allow easy removal by an unauthorized person of a watermark signal embedded in digital data, particularly audio signal data and yet minimize distortion of original data. The objective is achieved in part by correlating the coefficients of wavelet transformation of magnitudes of Fourier transformed audio signal with the coefficients of discrete cosine transformed watermark signal. The coefficients of transformed audio signal data and scaled-down coefficients of watermark signal are added, inverse wavelet transformed and inverse Fourier transformed to produce watermarked audio signal data.

In accordance with one aspect of the present invention, a method for inserting a watermark signal into audio signal data comprises the steps of: Fourier transforming audio signal data in the frequency domain in a form of first components and second components; wavelet transforming absolute values of the first components to generate first spectral coefficients; discrete cosine transforming a watermark signal to generate second spectral coefficients; combining the first spectral coefficients and the second spectral coefficients; and Inverse wavelet transforming the combined coefficients.

The first components and second components may be the magnitudes and phases of coefficients respectively. Preferably, the step of combining includes a step of performing a weighted addition of the first and second spectral coefficients. It is preferable for the method to further comprise a step of inverse Fourier transforming the output of the inverse wavelet transforming by using the phases of coefficients. Also, it is preferable for the method to further comprise a step of multiplying information from the first spectral coefficients to the second spectral coefficients prior to the combining step. Further, the method may comprise a step of multiplying a scaling factor to the second spectral coefficients prior to said combining step. The scaling factor may be in the range of 0.01–0.05. Preferably, the information is a function of the sign of the first spectral coefficients.

In accordance with another aspect of the present invention, a method for extracting a watermark from a watermark-embedded audio data comprises the steps of Fourier transforming a watermark-embedded audio data and an original audio data to generate the first components and the second components respectively; Wavelet transforming the absolute magnitudes of the first components of the watermark-embedded audio data and the original audio data, respectively; taking the differences between wavelet-transform coefficients of the watermark-embedded audio data and the original audio data; and inverse-discrete cosine transforming the differences.

Preferably, the method further comprise a step of multiplying the sign of the wavelet-transform coefficients associated with the original audio data to wavelet-transform coefficients associated with the watermark-embedded audio data. Further, the multiplying step may comprise a step of multiplying a scaling factor to wavelet coefficients associated with the watermark-embedded audio data. The sign may be obtained by using a signum function. The scaling factor may be in the range of 20–100.

BRIEF DESCRIPTION OF THE DRAWINGS

The aforementioned aspects and other features of the invention will be explained in the following description, taken in conjunction with the accompanying drawings wherein.

DETAILED DESCRIPTION OF THE PREFERRED INVENTION

Figure 1:
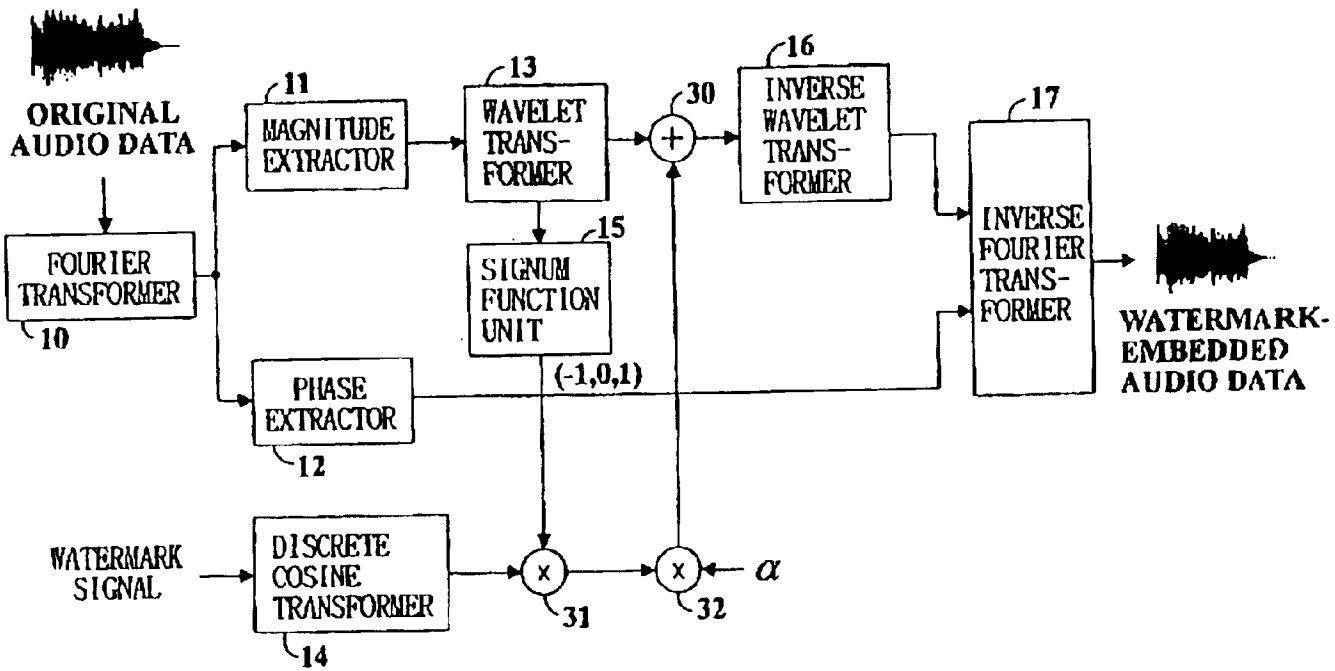
FIG. 1 is a block diagram for inserting a watermark signal into audio signal data according to the present invention.

Referring to FIG. 1, a digital watermarking method and system according to the present invention will be described.

When a watermark-signal is transformed using a transformation scheme, the shape of the original watermark is not preserved. The present invention is based on the idea that a watermark of an impulse type is hard to delete because the watermark, after inventive transformations, would be distributed over the whole transform plane. Thus it helps to prevent unauthorized copying of a legitimate data.

Among many transformation schemes, the present invention employs DCT to transform a watermark, because coefficients of DCT transformed plane are real values, whereas coefficients of Fourier-transformed plane have complex components, making it more difficult to match with original image data.

When inserting a watermark (W) into original audio data (S) to form a watermark-embedded audio data (S), the quality of the watermark embedded audio data (S') can be controlled by adjusting the interval between the original audio data (S) and the watermark (W) using a scaling parameter α, as shown in Eq. 1.

[Equation 1]

$$S'_i = S_i + aW_i \quad \text{Eq. 1a}$$

$$S'_i = S_i(1 + aW_i) \quad \text{Eq. 1b}$$

$$Si'_i = S_i(e^{aW_i}) \quad \text{Eq. 1c}$$

Eq. 1a is always invertible. Eqs. 1b and 1*c* are invertible when Wi±0. If Eqs. 1b and 1*c* are employed, the security of watermarks may not be maintained for various processes in multimedia applications. Thus, the present invention utilizes Eq. 1a.

Figure 2:
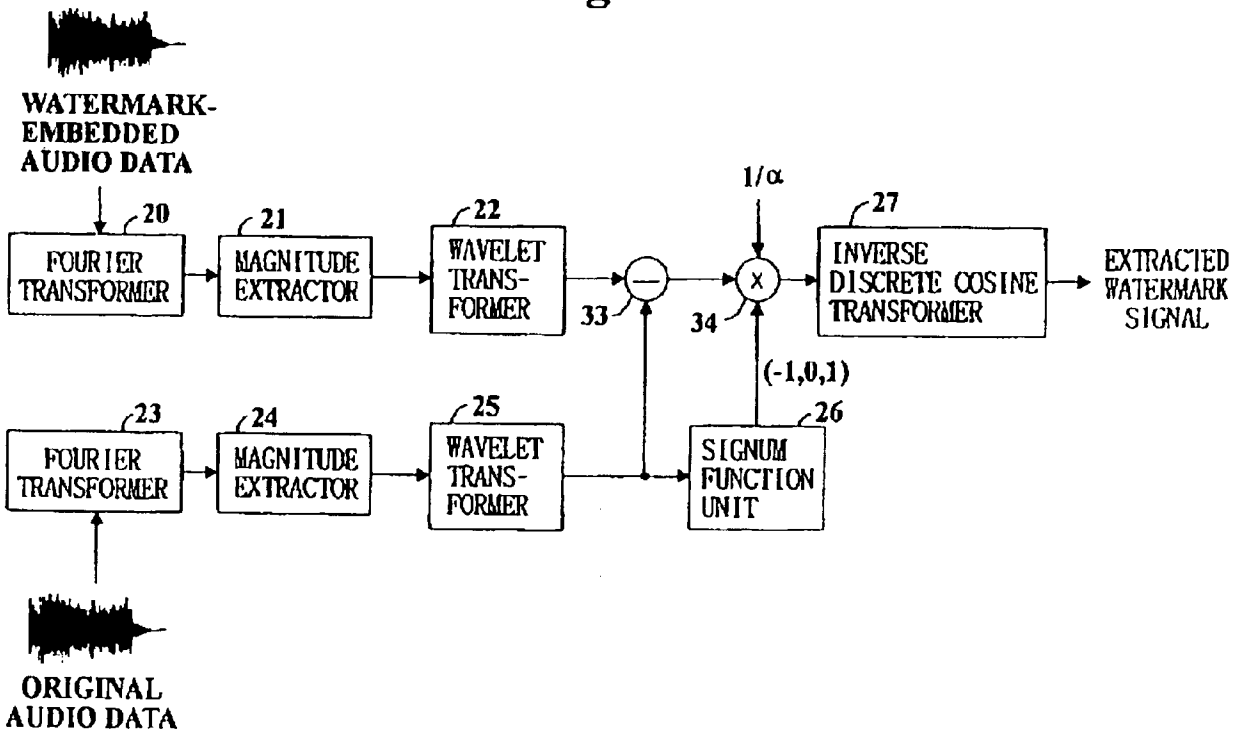
FIG. 2 is a block diagram for extracting a watermark signal from the watermark embedded audio signal data

FIGS. 1 and 2 show processes of watermarking original digital data and extracting the watermarks, in accordance with the present invention Referring to FIG. 1, a process of watermarking original digital data will be described.

When original audio data to embed a watermark is inputted to processing means (not shown in the figure), the processing means Fourier-transforms the original audio data by using a predetermined algorithm to generate amplitude and phase components. A Fourier Series is used for the Fourier transform, as follows:

$$X_n = \frac{1}{T_o}\int_{T_o} x(t)e^{-j2\pi n\int_n t}\,dt \qquad \text{[Equation 2]}$$

$$x(t) = \sum_{n=-\infty}^{\infty} X_n e^{j2\pi n\int_n t}$$

The process of Fourier-transforming a continuous function f(x) using the infinite series of Eq. 2 may be defined as Eq. 3.

$$X(f) = \int_{-\infty}^{\infty} x(t)e^{-j2\pi\int t}dt \qquad \text{[Equation 3]}$$

$$x(t) = \int_{-\infty}^{\infty} X(f)e^{-j2\pi\int t}df$$

For Example $$X(t) = \sum_{n=-\infty}^{\infty}\delta(t-nT_o)$$

$$X_n = \frac{1}{T_o}\int_{4.8T_0}^{6.8T_0}\delta(t-5T_o)e^{-j2\pi n\int_0 t}\,dt$$

$$= \frac{1}{T_o} \leftarrow f_oT_o = 1$$

$$x(t) = \sum_{n=-\infty}^{\infty} X_n e^{-j2\pi n\int_o t}$$

$$= \frac{1}{T_o}\sum_{n=-\infty}^{\infty} e^{-j2\pi n\int_o t}$$

$$X(f) = \int_{-\infty}^{\infty}\sum_{n=-\infty}^{\infty}\delta(t-nT_o)e^{-j2\pi fl}\,dt$$

$$= \sum_{n=-\infty}^{\infty}\int_{-\infty}^{\infty}\delta(t-nT_o)e^{-j2\pi fl}\,dt$$

$$= \sum_{n=-\infty}^{\infty} e^{-j2\pi nfT_o}$$

$$= \int_{-\infty}^{\infty}\frac{1}{T_o}\sum_{n=-\infty}^{\infty} e^{-j2\pi n\int_o t}e^{-j2\pi fl}\,dt$$

$$= \frac{1}{T_o}\sum_{n=-\infty}^{\infty}\int_{-\infty}^{\infty} e^{-j2\pi(f+nf_nt)}\,dt$$

$$= \frac{1}{T_o}\sum_{n=-\infty}^{\infty}\delta(f+nf_o)$$

where $$\sum_{n=-\infty}^{\infty}\delta(t-nT_o) \leftarrow \rightarrow f_o\sum_{n=-\infty}^{\infty}\delta(f+nf_o)$$

$$\sum_{n=-\infty}^{\infty}\delta(t-nT_o) = \frac{1}{T_o}\sum_{n=-\infty}^{\infty} e^{-j2\pi nf_ot}$$

$$\sum_{n=-\infty}^{\infty}\delta(f-nf_o) = \frac{1}{f_0}\sum_{n=-\infty}^{\infty} e^{-j2\pi nfT_p}$$

$$\sum_{n=-\infty}^{\infty}\delta(f-n) = \sum_{n=-\infty}^{\infty} e^{-j2\pi nf} \leftarrow T_0 = f_o = 1$$

In the Fourier transform as defines in Eq. 3, it is preferable to use complex values, since a complex value may represent both the amplitude at a time, as shown below.

[Equation 4]

$$F(u)=R(u)+jI(u)$$

$$F(u)=|F(u)|e^{j\phi(u)}$$

In Eq. 4, Fourier spectrum is expressed as:

$$|F(u)|=[R^2(u)+I^2(u)]^{1/2}$$

the phase is expressed as:

$$\phi(u) = \tan^{-1}\left[\frac{I(u)}{R(u)}\right]$$

the power spectrum is expressed as:

$$P(u)=|F(u)^2=R^2(u)+2(u)$$

where u represents a variable for frequency.

By employing Euler's equation, i.e., exp[−j2πux]= cos2πx, the Fourier transform can be represented by the equation defined in Eq, 5.

$$T\{f(x,y)\} = \qquad \text{[Equation 5]}$$

$$F(u,v) = \int_{-\infty}^{\infty}\int_{-\infty}^{\infty} f(x,y)\exp[-j2\pi(ux+vy)]dxdy$$

$$T^{-1}\{f(u,v)\} =$$

$$F(x,y) = \int_{-\infty}^{\infty}\int_{-\infty}^{\infty} f(u,v)\exp[-j2\pi(ux+vy)]dudv$$

Therefore, the Fourier spectrum, phase, and power spectrum can be given as follows:

Fourier spectrum:

$$|P(u,v)|=[R^2(u,v)+I^2(u,v)]^{1/2}$$

Phase:

$$\Phi(u,v) = \tan^{-1}\left[\frac{I(u,v)}{R(u,v)}\right]$$

Power spectrum:

$$P(u,v)=|F(u,v)^2=R^2(u,v)+I^2(u,v)$$

As shown above, Fourier transform employs infinite series to transform analog signals to sampled digital signals. However, in order to implement Fourier transform by a computer, modified Fourier transform for sampled data, i.e., Discrete Fourier Transform (DFT) is used on behalf of Fourier transform. If DFT is employed, f(x) can be given as Eq. 6.

$$X[m] = \sum_{n=0}^{N-1} x[n]e^{-j\frac{2\pi mn}{N}},\ m[0, N-1] \quad \text{[Equation 6]}$$

$$= X\left(e^{-j\frac{2\pi m}{N}}\right),$$

$$x[n] = \sum_{m=0}^{N-1} X[m]e^{j\frac{2\pi mn}{N}},\ n[0, N-1]$$

Also, inverse $$X\left(e^{\frac{2\pi m}{N}}\right)$$

is defined as Eq. 7, when the rotational initial and maximum value is X[n].

$$x[n]_N = \sum_{m=0}^{N-1} X\left(e^{\frac{2\pi m}{N}}\right)e^{j\frac{2\pi mn}{N}} \quad \text{[Equation 7]}$$

$$= \sum_{k=-\infty}^{\infty} x[n-kN]\text{: Period } N$$

Digital audio data is Fourier transformed at a Fourier transformer 10 as described above while a watermark signal is discrete cosine transformed at a discrete cosine transformer 14. Next, the magnitudes of the coefficients of Fourier transformed audio data, obtained by a magnitude extractor 11, are wavelet transformed at a wavelet transformer 13. Now the signs (+, −, 0) of the audio's coefficients are respectively multiplied to the spectral coefficients of the watermark signal at the first multiplier 31 in order to correlate the audio signal and the watermark signal to certain extent. The sign can be easily obtained by using the signum function unit 15, which outputs 1, −1 or 0 depending on the sign/polarity of an input value disregarding the magnitude. The spectral coefficients of the watermark signal are further multiplied by a scaling factor α at the second multiplier 32 so as not change the audio signal's quality as perceived by the listener. The scaling factor is preferably in the range of 0.01 to 0.05. In other words the influence of the scaled watermark signal's coefficients on the spectral shape of the audio data is minimized so that watermark-embedded audio signal is perceptively no different from the original audio signal from the perspective of the listener. The scaled coefficients are then added to the coefficients of wavelet transformed audio signal data at an adder 30. The added coefficients are inverse wavelet transformed at an inverse wavelet transformer 16 to generate adjusted coefficient magnitudes. Finally, the adjusted magnitudes, generated by the inverse wavelet transformer, and the phase component of the audio signal data, obtained by a phase extractor 12, are input to an inverse Fourier transformer 11 to finally generate watermark-embedded audio data.

Next a watermark extraction from a watermark-embedded audio data will be described referring to FIG. 2. A watermark-embedded audio data undergoes a Fourier transform at a Fourier transformer 20 to generate a first set of coefficients in the frequency domain. Simultaneously or independently an original audio data is also Fourier transformed at a Fourier transformer 23 to generate a second set of coefficients in the frequency domain. The magnitudes of the two set of coefficients, obtained by magnitude extractors 21 and 24 respectively, are further wavelet transformed at wavelet transformers 22 and 25 respectively. The wavelet coefficients associated with the original audio data are subtracted from those with the watermark-embedded audio signal at a subtracter 33. The differences in the coefficients are multiplied by a scaling factor (1/α) and the sign (1 for positive, 0 for none and −1 for negative) of the wavelet transform coefficients associated with the original audio data at a multiplier 34. The sign can be obtained by using a signum function unit 26. Finally, the scaled coefficients, multiplied by the output of the signum function unit 26 is inverse discrete cosine transformed at an inverse discrete cosine transformer 27 to produce a watermark which had been embedded in the original audio data.

The watermarking method described above can be implemented on a single chip integrated circuit or discrete components. Specifically, a digital signal processor may be programmed to perform the steps in the inventive watermarking.

While there has been described and illustrated a method and system for inserting a watermark data by discrete cosine transforming the watermark signal and Fourier/wavelet transforming an original audio data, it will be apparent to those skill in the art that variations and modifications are possible without deviating from the broad principles and teachings of the present invention which shall be limited solely by the scope of the claims appended hereto.

What is claimed is:

1. A method for inserting a watermark signal into audio signal data, comprising the steps of:

Fourier transforming audio signal data in the frequency domain in a form of first components and second components;

wavelet transforming absolute values of said first components to generate first spectral coefficients;

discrete cosine transforming a watermark signal to generate second spectral coefficients;

combining said first spectral coefficients and said second spectral coefficients; and inverse wavelet transforming the combined coefficients.

2. The method for inserting a watermark signal into audio signal data as claimed in claim 1, wherein said first components and second components are the magnitudes and phases of coefficients respectively.

3. The method for inserting a watermark signal into audio signal data as claimed in claim 1, wherein said step of combining includes a step of performing a weighted addition of said first and second spectral coefficients.

4. The method for inserting a watermark signal into audio signal data as claimed in claim 3, further comprising a step of inverse Fourier transforming the output of said inverse wavelet transforming by using said phases of coefficients.

5. The method for inserting a watermark signal into audio signal data as claimed in claim 4, further comprising a step of multiplying information from said first spectral coefficients to said second spectral coefficients prior to combing step.

6. The method for inserting a watermark signal into audio signal data as claimed in claim 5, further comprising a step of multiplying a scaling factor to said second spectral coefficients prior to said combining step.

7. The method for inserting a watermark signal into audio signal data as claimed in claim 6, wherein said scaling factor is in the range of 0.01–0.05.

8. The method for inserting a watermark signal into audio signal data as claimed in claim 5, wherein said information is a function of the sign of said first spectral coefficients.

9. An apparatus for inserting a watermark signal into audio signal data, comprising:

a means for Fourier transforming audio signal data into amplitude components and phase components;

a means for wavelet transforming absolute values of said amplitude components to generate first spectral coefficients;

a means for discrete cosine transforming a watermark signal to generate second spectral coefficients;

a means for combining said second spectral coefficients to said first spectral coefficients respectively; and inverse wavelet transforming the coefficients.

10. The apparatus for inserting a watermark signal into audio signal data as claimed in claim 9, wherein said combining means comprises a means for multiplying an information from said first spectral coefficients to said second spectral coefficients.

11. The apparatus for inserting a watermark signal into audio signal data as claimed in claim 10, wherein said combining means comprises a means for multiplying a scaling factor to said second spectral coefficients.

12. The apparatus for inserting a watermark signal into audio signal data as claimed in claim 11, wherein said scaling factor is in the range of 0.01–0.05.

13. The apparatus for inserting a watermark signal into audio signal data as claimed in claim 9, further comprising a means for inverse Fourier transforming said respectively combined coefficients using said phase components.

14. The apparatus for inserting a watermark signal into audio signal data as claimed in claim 10, wherein said information is a function of the sign of said first spectral coefficients.

15. A method for extracting a watermark from a watermark-embedded audio data, comprising steps of:

Fourier transforming a watermark-embedded audio data and an original audio data to generate first components and second components respectively;

Wavelet transforming the absolute magnitudes of said first components of said watermark-embedded audio data and said original audio data respectively;

taking the differences between wavelet-transform coefficients of said watermark-embedded audio data and said original audio data; and inverse-discrete cosine transforming said differences.

16. The method for extracting a watermark from a watermark-embedded audio data as claimed in claim 15, further comprising a step of multiplying the sign of said wavelet-transform coefficients associated with said original audio data to wavelet-transform coefficients associated with said watermark-embedded audio data.

17. The method for extracting a watermark from a watermark-embedded audio data as claimed in claim 16, wherein said multiplying step further comprises a step of multiplying a scaling factor to wavelet coefficients associated with said watermark-embedded audio data.

18. The method for extracting a watermark from a watermark-embedded audio data as claimed in claim 16, wherein said sign is obtained by using a signum function.

19. The method for extracting a watermark from a watermark-embedded audio data as claimed in claim 17, wherein said scaling factor is in the range of 20–100.

20. An apparatus for extracting a watermark from a watermark-embedded audio data, comprising:

a means for Fourier transforming a watermark-embedded audio data and an original audio data to generate first components and second components respectively;

a means for wavelet transforming the absolute magnitudes of said first components of said watermark-embedded audio data and said original audio data respectively;

a means for taking the differences between wavelet-transform coefficients of said watermark-embedded audio data and said original audio data; and a means for inverse-discrete cosine transforming said differences.

21. The apparatus for extracting a watermark from a watermark-embedded audio data as claimed in claim 20, further comprising a means for multiplying the sign of said wavelet-transform coefficients associated with said original audio data to wavelet-transform coefficients associated with said watermark-embedded audio data.

22. The apparatus for extracting a watermark from a watermark-embedded audio data as claimed in claim 21, further comprising the means for multiplying a scaling factor to wavelet coefficients associated with said watermark-embedded audio data.

23. The apparatus for extracting a watermark from a watermark-embedded audio data as claimed in claim 21, wherein said sign is obtained by using a signum function.

24. The apparatus for extracting a watermark from a watermark-embedded audio data as claimed in claim 22, wherein said scaling factor is in the range of 20–100.

* * * * *